US005380988A

United States Patent [19]

Dyer

[11] Patent Number: 5,380,988

[45] Date of Patent: Jan. 10, 1995

[54] HEATED MAT STRUCTURE FOR MELTING ICE AND SNOW

[76] Inventor: C. William Dyer, N. 18120 Hilltop Rd., Colbert, Wash. 99005

[21] Appl. No.: 174,762

[22] Filed: Dec. 23, 1993

Related U.S. Application Data

[63] Continuation of Ser. No. 875,313, Apr. 29, 1992, abandoned.

[51] Int. Cl.[6] ..... H05B 3/10

[52] U.S. Cl. ..... 219/548; 219/213; 392/437

[58] Field of Search ..... 219/213, 548, 217, 507; 392/437, 435, 436, 436, 439/391, 393, 389

[56] References Cited

U.S. PATENT DOCUMENTS

| | | | |
|---|---|---|---|
| 2,844,696 | 7/1958 | Coster | 293/435 |
| 3,041,441 | 6/1962 | Elbert | 392/435 |
| 3,721,800 | 3/1973 | Eisler | 219/213 |
| 4,439,666 | 3/1984 | Graham | 219/213 |
| 4,717,812 | 1/1988 | Makita | 219/528 |
| 4,967,057 | 10/1990 | Bayless | 219/213 |

FOREIGN PATENT DOCUMENTS

| | | |
|---|---|---|
| 2394902 | 2/1979 | France . |
| 2247025 | 9/1972 | Germany . |
| 2607949 | 9/1972 | Germany . |
| 3036098 | 2/1982 | Germany . |
| 0038535 | 2/1985 | Japan . |
| 0038988 | 2/1989 | Japan . |
| 552910 | 4/1943 | United Kingdom . |
| 1315268 | 5/1973 | United Kingdom . |
| 2196818 | 5/1988 | United Kingdom . |

OTHER PUBLICATIONS

"Warm Welcome", Brochure; Lighthouse Internation, Ltd.

*Primary Examiner*—Bruce A. Reynolds
*Assistant Examiner*—Michael D. Switzer
*Attorney, Agent, or Firm*—Wells, St. John, Roberts, Gregory & Matkin

[57] ABSTRACT

A heated mat structure provides a plurality of thin heated mats, each releasably interconnected in electrical parallel through an electrical powering system providing low voltage current. Each heated mat comprises relatively thin rectilinear laminated structure, having a rigid back panel with fastening means for positional maintenance, supporting a thin heating lamina having an element formed of electrically resistive metallic foil imbedded in plastic sheet material which in turn supports an outer surfacing lamina having an exposed surface of high friction material to prevent slipping. The laminae may carry plastic sheet material between adjacent surfaces and about peripheral edges to aid interconnection and isolation. All adjacent structural surfaces are mechanically joined. Each pad provides an electrical connector communicating spacedly from interconnection with its foil heating element. Each electrical connector is of the vampire type that may be releasably interconnected at selected positions along an elongate two-wire conductor to allow various modular arrays of plural heating mats about that conductor. The electrical system is powered by ordinary household current.

3 Claims, 2 Drawing Sheets

HEATED MAT STRUCTURE FOR MELTING ICE AND SNOW

RELATED APPLICATIONS

This patent issued from a continuation-in-part application based on U.S. patent application Ser. No. 70/875,313, filed Apr. 29, 1992, which is now abandoned.

BACKGROUND OF INVENTION

1. Field of Invention

My invention relates generally to electrically powered heating mats, and more particularly to a selectively positional array of thin modular mats powered by low voltage electrical current.

2. Background and Description of Prior Art

Electrically powered mat-like devices have long been known and used for generating heat for various purposes and through the course of their development such devices have become quite sophisticated and specialized for particular purposes. The instant invention provides a new member of this class of device that is particularly adapted for use on generally horizontal surfaces to melt environmental ice or snow that might otherwise accumulate thereon.

The accumulation of ice and snow on outdoor structural surfaces traversed by people is an ever present problem in the Northern climes during winter weather. The problem in general is resolved by physical removal of the ice and snow, and this presents a reasonably satisfactory solution that is practically obtainable for open horizontal surfaces of some areal extent where normal mechanical removal methods may be readily applied. The problem becomes more acute, however, in smaller adjacent but discontinuous areas, and especially such areas that have substantial or concentrated foot traffic, like door steps and entryways to structures which present a perennial problem for snow removal.

One approach to the debris removal from such areas has been the use of heating, sometimes by heating the structure involved or at least its surface by internal means or commonly by application of some heat generating device to the surface such as a heated mat or pad. Various, such heated mats have heretofore become known and in the course of their development they become quite sophisticated, though none seem to have satisfactorily resolved all problems associated with their use and purpose. The instant invention provides a new and novel member of this class of device that addresses unsolved problems.

The configurational embodiment of heated mats is critical to their practical utility and has not been well addressed by prior devices. Such a mat must be relatively thin to allow use on surfaces over which other objects must pass, such as a door mat over which a door may move. Additionally, a mat of any substantial thickness may disrupt the normal and habitual use of an area being traversed by an individual to cause slipping or falling, especially if used on part but not all of that area or on a flight of stairs or similar platforms. The mat also must be quite rigid to maintain configurational integrity during use, reduce potential slipping or failing during use, prevent slipping or falling, and allow objects to be moved thereover when in contact therewith.

The areal size and configuration of a mat for reasonable utility must be such as to fit on a substantial number of surfaces on which it is to be used. If a mat extends beyond the periphery of a supporting surface, it will provide problems in use and those problems will tend to substantially reduce its reliability and useful life. I resolve these problems by providing a rectilinear mat having an areal size and peripheral configuration not larger than the same parameters of ordinary steps and one with a rigid back formed of fiberglass fibers embedded in a polymeric matrix for strength, as opposed to the relatively flexible prior structures of greater thickness and often substantially greater areal extent.

Such a mat with a rigid back generally requires some means for positional maintenance to avoid motion between it and a rigid supporting surface during use. This requirement for positional maintenance has often been ignored or alleviated in the prior art by providing a flexible mat, but this solution is not effective. In contradistinction I provide alternative fastening by adhesive patches or mechanical fasteners extending through the mat and into fastening engagement with an underlying supporting surface. This type of fastening in the harsh environments in which heating pads are commonly used provides substantially greater potentiality of positional maintenance of my mat that varies almost directly with its safety of use.

Functionally prior mats have experienced difficulties in providing uniform heat over the entire mat surface and in providing sufficient heat to melt ice and snow without expending excessive energy. The prior art has either tended to ignore this problem, solved it by providing excessive amounts of heat to provide a sufficient heat level, or have attempted to use some type of thermostatic control. The provision of excessive energy to provide minimal required heat in non-uniformly heated areas is not economically feasible and thermostats have not been particularly effective because they generally do not measure heat at points where it is required nor do they measure the amount of that heat necessary to accomplish proper functioning. Thermostats generally measure the temperature of a mat in a limited area which is not necessarily related to heat work or its areal uniformity.

I solve this problem by providing a heating element that is formed of a continuous strip of electrically resistive metallic foil that is uniformly arrayed over the entire mat area and covers a substantial portion of the mat to provide substantially uniform heat over the entire mat surface. This type of heating element provides secondary benefits. The foil allows electrical powering of the heating mat with low voltages of either direct or alternating current and has a high efficiency ratio to use a minimal amount of electrical energy during periods of continuous operation. The structure of my pad will provide tertiary benefits in that its lower portion is somewhat thermally resistive and tends to direct substantially more of the heat produced by the heating element upwardly than downwardly, so that the heat produced is effectively used in melting functions rather than in heating an underlying supporting structure.

Areas from which ice and snow are desired to be removed often are non-contiguous and of varying configuration and positional array. Most prior heating mats have serviced only a single contiguous area and those that have become known to service multiple spacedly related areas have been adapted to service only such areas as are of predetermined configuration and areal relationship. My invention in contradistinction provides a plurality of modular heating mats that may be spacedly arrayed as desired in relationship to a linear conductor furnishing power to the plural mats. This function is allowed by the particular construction of the electrical powering system and the interconnection of individual mat modules thereto.

Each modular unit is interconnected in electrical parallel with a two-wire conductor by a so-called "vampire" connector which allows releasably adjustable positioning anywhere along the conductor. Such vampire connectors provide two pointed contact elements that pierce the insulation on a conductor to contact the conducting wires carried therein to power the individual module, but yet allow removal and replacement of the connector as desired with subsequent reformation of the resilient insulating element about the conducting wires. This type of interconnection is allowed especially by reason of the low voltage power supply of my system which provides substantial safety from injury caused by shorts or improper or incomplete resealing of the insulation about the electrical wires. The modular nature of the several heating pads allows use of my system on surfaces of varying configurations by use of varying numbers and arrays of modules to make system use almost universal in nature.

Most heated mats heretofore known that have been electrically powered have used ordinary household type electric current providing electrical power of a single phase alternating nature at one hundred twenty volts. My invention is distinguished from these devices by providing resistive heating elements that are powered by current preferably of not more than fifty volts and of either alternating or direct nature. This type of current not only avoids wastage as aforesaid but also is universally safe for use with humans or animals, even in the severe environments in which heating mats are commonly used. Even if an electrical short circuit should accidentally occur or if current should pass through a user to some ground source, the voltage is low enough so as to cause no physical injury or harm to either human or lower animal. The lower voltage also limits the amount of power that is distributed to the several mat units and provides a maximum potential power to provide an absolute limit of power usage for automatic non-thermostatic control. The powering system may provide a transformer so that ordinary commonly available household current may be used to power the system and includes traditional switching means to maintain the system in either condition for a predetermined time interval.

A heated mat system is particularly adapted for use on or about entry portals where foot traffic is concentrated and configurational parameters commonly quite limited, such as about doorways and on stairs leading thereto or therefrom in both structures and vehicles. With use of my mat structure in vehicles, it should be particularly noted that many commercial vehicles provide a low voltage powering system that is available for powering the system and if not, powering systems provided may be easily transformed to a low voltage current. If desired, my invention may be operated at either higher or lower voltages with appropriate modification of the electrical components.

My invention resides not in any one of these features per se, but rather in the synergistic combination of all of the structures of my system that combine synergistically to provide the functions necessarily flowing therefrom, as herein specified and claimed.

SUMMARY OF INVENTION

My heated mat structure provides plural mats each releasably communicating with a low voltage electrical powering system in selectable array along an elongate conductor.

Each mat provides a laminate structure having a rigid back supporting an electrically resistive foil heating lamina that in turn supports a higher friction surface lamina, all structurally interconnected in sequential adjacency. Each mat provides a vampire connector extending spacedly therefrom to releasably interconnect with an elongate two-wire insulated electrical conductor. Each mat defines plural spaced holes and optionally carries adhesive fastening strips for mechanical fastening to an underlying supporting surface.

The electrical powering system provides a step-down transformer which interconnects with a household electrical system to provide current at low voltage to an elongate insulated two-conductor electrical cable extending spacedly from the transformer. Individual mats are releasably interconnected in electrical parallel with each other in selected array along the electrical conductor by their vampire connectors.

In providing such a structure, it is:

A principal object to provide a heated mat system for melting environmental ice and snow on flat surfaces and especially such surfaces that carry heavy pedestrian traffic as stairways and areas adjacent entryways.

It is a further object to provide such a system that has plural heated mats that may be variously arrayed and releasably interconnected at selected points along an elongate electrical conductor by means of vampire connectors.

A further object is to provide such a mat that uses an electrically resistive foil heating element arrayed so that the heating element occupies a substantial portion of the area of the mat to provide substantially uniform heat over the entire mat surface.

A further object is to provide such a mat that has a relatively thin, substantially rigid back of lower thermal conductivity to direct more heat upwardly than downwardly and provides means for mechanical fastening to an underlying supportative surface.

A still further object is to provide such a mat structure that is of new and novel design, of rugged and durable nature, of simple and economic manufacture and otherwise well adapted to the uses and purposes for which it is intended.

Other and further objects of my invention will appear from the following specification and accompanying drawings which form a part hereof. In carrying out the objects of my invention, however, it is to be remembered that its accidental features are susceptible of change in design and structural arrangement with only one preferred and practical embodiment of the best known mode being illustrated as required.

BRIEF DESCRIPTION OF DRAWINGS the accompanying drawings which form a part hereof and wherein like numbers of reference refer to similar parts throughout:

DESCRIPTION OF THE PREFERRED EMBODIMENT

Figure 1:
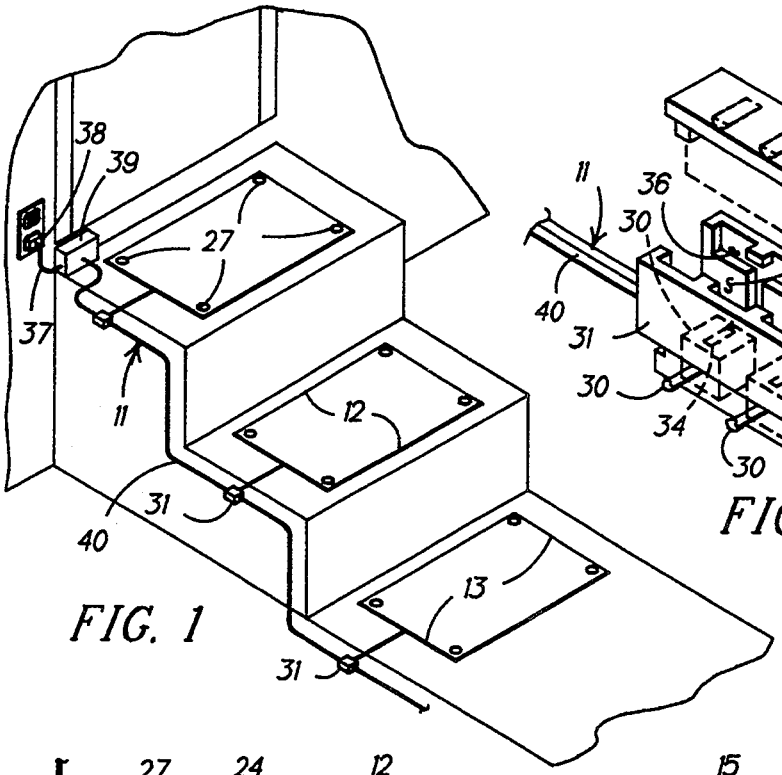
FIG. 1 is a partially cut-away view of my heated mat structure, in operative position on a flight of steps adjacent an entryway, showing its various parts, their configuration and relationship.
Figure 4:
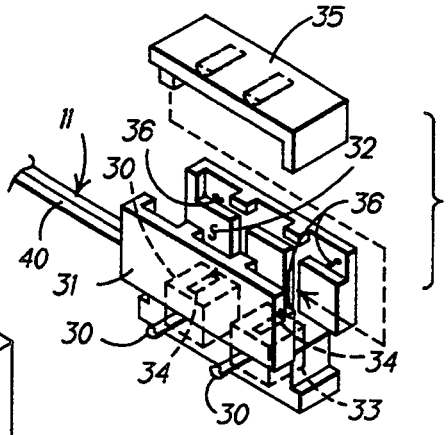
FIG. 4 is an expanded isometric view of a vampire clip that releasably fastens a mat to the electrical powering system.
Figure 2:
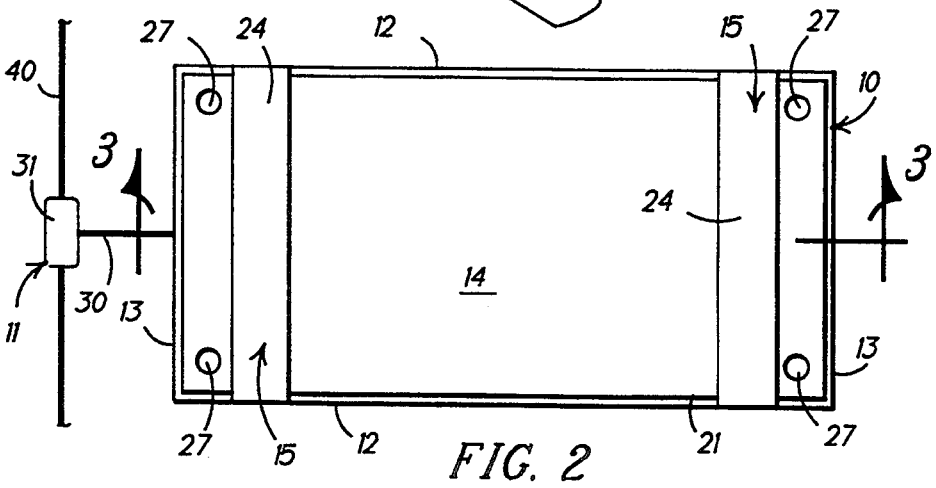
FIG. 2 is an orthographic surface view of the back or under surface of an individual heated mat.

Referring to the drawings in more detail, it is there seen that my heated mat structure comprises generally plural individual mats 10 releasably interconnected to electrical powering system 11 energized by an ordinary one hundred twenty volt, single phase household electrical system.

Mat 10 is a flat rectilinear member having similar longer sides 12 and shorter ends 13. The mat is formed of lamina of similar peripheral shape and dimension comprising back 14 carrying adhesive elements 15 on its exposed or undersurface and supporting on its upper surface in sequential order plastic layer 16, heating lamina 17, plastic layer 18 and upper surface layer 19. These elements are all structurally interconnected by mechanical joinder of adjacent surfaces, preferably by means of adhesion, though they may be fastened by other appropriate means. The sides 12 and ends 13 may be joined and covered by peripheral covering strip 20, but this is not necessary to protect the integrity of the mat if appropriate adhesives are used to interconnect the surfaces of its adjacent elements. If desired, the side strip 20 might comprise the same material as the adhesive interconnecting the various mat lamina.

Back 14 is a relatively thin, semi-rigid element formed of a resinous or polymeric plastic matrix impregnated with fiberglass. The material from which the back is formed should be reasonably electrically insulative in nature and should have reasonably low thermal conductivity so as to cause more than half of the heat produced in heating lamina 17 thereabove to pass upwardly rather than downwardly through the back element. The back element will generally be flat in configuration, with a planar lower surface 21 to fit in adjacency with an underlying supportive surface which most commonly will also be of flat planar nature. If the mat is to be used on a surface of some other configuration, however, the mat may be configured to appropriately fit in surface adjacency upon a supportive surface and such configuration is within the scope of my invention.

Exposed lower surface 21 of the back carries relatively thin, spaced adhesive pads 15 to aid positional maintenance of the mat on a supporting surface if desired. These pads 15 provide adhesive coating 23 on both upper and lower surfaces, and the lower surface is covered with protective membrane 24 that prevents exposure of that adhesive material so long as the membrane is in place. It is possible that the adhesive pads 15 might be replaced with other similar type fastening structures such as hook and pile fabric fasteners and that either type of fastener might extend over the entire undersurface of the mat. Such concepts are within the scope of my invention as the means of positionally maintaining the mat is not of essence to my invention and other known means may be substituted to accomplish this result.

Figure 5:
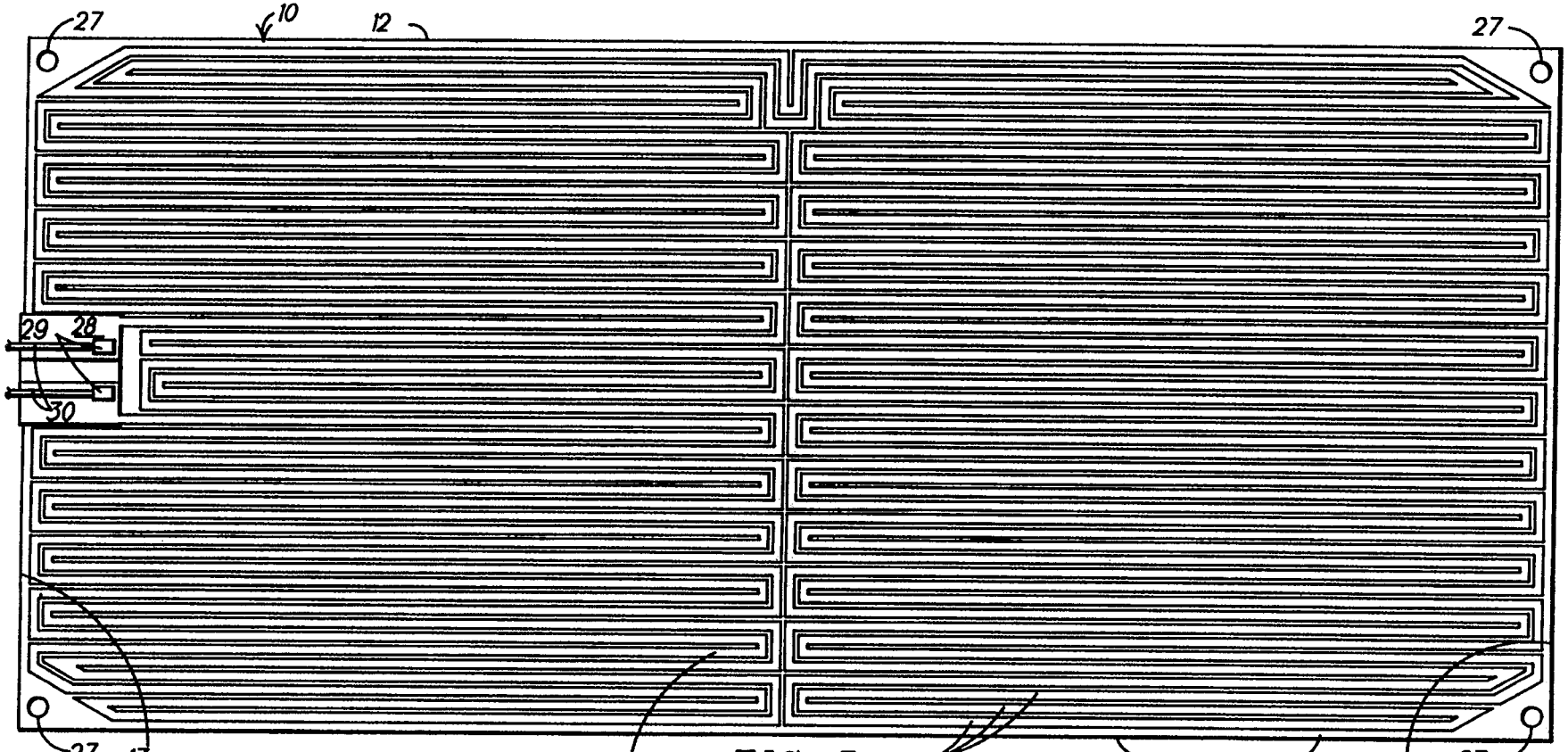
FIG. 5 is an orthographic surface or plan view of the foil heating element of the pad of FIG. 2, with the upper surface of the lamina removed.

Heating lamina 17 is a thin element supporting an electrically resistive metallic foil heating element 25 embedded in and covered by a plastic matrix 26. Foil 25 is not more than three of four mills in thickness and of substantial area so that it covers a substantial portion of the area of a mat. The foil heating element 25 constitutes a single elongate electrically conductive strip arranged so that it is substantially uniformly distributed over the entire mat surface with only relatively small, uniformly spaced areas between portions of foil so as to substantially uniformly heat the entire mat area. The array of preference is a rectilinearly serpentine arrangement somewhat as illustrated in FIG. 5, though undoubtedly other geometrically patternation may accomplish the essential requirements and would be within the scope of my invention. In the instance illustrated, the triangular corner portions of the heating element 17 are devoid of resistive foil to allow definition of fastening holes 27 in the corner portions of the mat.

The heat required at the upper surface of a heated mat to effectively melt ice and snow is in the range of approximately 0.15 to 1 watt per square inch of mat surface or a total of about 144 watts for a mat of $8\times18$ inch size and 192 watts for a mat of $8\times24$ inch size. To avoid excessive voltage drops in a mat system having more than four or five mats, I prefer to use heating elements that will operate at either twelve or twenty-four volts, but operate those mats at the higher voltage so that any drop in voltage in such a system will be proportionally less and allow use of twelve or more mats as required to service an ordinary flight of stairs. The electrical characteristics of the heating element should also be such as to allow use of a resistive foil having a width of at least approximately one-eighth inch (0.32 cm.) and a total area of at least approximately one-fourth of that of a mat carrying the element to aid uniform heating over an entire mat surface.

The heating element 17 described may be conveniently and economically formed by known printing methods, whereby a first base sheet of electrically insulative plastic is created and imprinted with foil element 25; a second sheet of insulative plastic is then mechanically fastened to the first sheet, generally by adhesion or fusion, to cover the foil and form a unitary lamina of substantial durability and reliability. The heating lamina may also be formed by die stamping of a sheet foil element which is then subsequently imbedded between and covered by two similar electrically insulative plastic sheets. Both methods of formation are known in the present day manufacturing arts, and either provides a product of substantial durability and reliability that is quite thin and of economic manufacture.

In the configuration illustrated, the two ends of the serpentine foil element 25 are adjacently positioned in the medial part of one end of the mat and each communicates electrically with an enlarged and reinforced contact strip 28. Each of these contact strips provides electrically communicating fasteners 29 to interconnect wires of a connector structure located at a spaced distance from the mat. In the instance illustrated, fasteners 29 are soldered connections between each contact strip 28 and the connector structure wire serving it. The contact strips 28 and fasteners 29 should be relatively thin and not of substantially greater thickness than foil heating element 25 so that they may be contained within the plastic matrix 26. Known fastening means other than soldering that fulfill this requirement are usable with my invention and within its scope. It is not necessary that the contact strips and fastening structure be embodied within plastic matrix 26, but if not, they should be covered by electrically insulative material and any voids thereabout filled with some type of material, such as the adhesive fastening the various adjacent surfaces of the elements of my mat together, to provide a water impervious seal.

The two plastic layers 16, 18 on either side of heating element 17 are both relatively thin and serve to isolate, insulate and protect the heating element without appreciably increasing the thickness of the overall mat. These elements are formed of a resilient polymeric sheet material generally of a thickness of four to five mills. The lower layer 16 may be thermally insulative in nature to aid in causing more heat to move upwardly from the heating lamina then moves downwardly through it. Such insulative function may be brought about by reflection of radiant heat and also lower thermal conductivity.

Upper surface lamina 19 is of the same peripheral configuration as back 14 and relatively thin. The upper surface layer of this lamina comprises material of strong, tough nature to protect the upper surface of my mat against wear, abrasion and other physically deteriorating forces that are encountered in normal use. Preferably the material also has an exposed surface of relatively high frictional character to aid in maintaining footing and preventing slippage of a user of the pad. Such materials are known commercially in the present day marketplace in the form of covering for stairs and walkways. These coverings are formed of semi-rigid polymeric or resinous material, often containing fibers, and either has particulate matter adhered to the exposed surface thereof or contains particulate material within its structure that tends to form protuberances on the exposed surface to aid in providing higher friction on that surface. Preferably, though not necessarily, the upper lamina should be electrically non-conductive and should have a relatively higher thermal conductivity than the back 14 and plastic layer 16.

Figure 3:
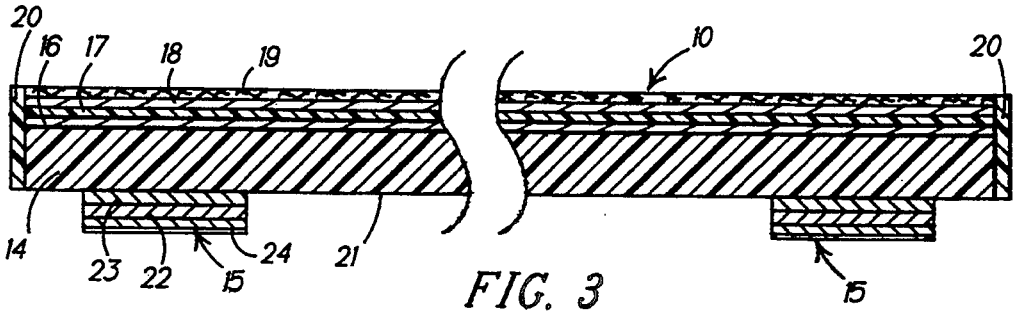
FIG. 3 is a somewhat enlarged cross-sectional view through the mat structure of FIG. 2, taken on the line 3—3 in the direction indicated by the arrows thereon, with the vertical dimension somewhat exaggerated for clarity of illustration.

All of the lamina described are fastened sequentially in surface adjacency as described and illustrated in FIG. 3. The fastening means of preference is adhesion by known adhesives placed between the adjacent surfaces. Fastening may also be accomplished by placing thin thermal plastic sheet material between the adjacent surfaces of each lamina and adhering the two adjacent surfaces by applying sufficient heat to cause the thermal material to adhere to the surfaces. Fastening by mechanical fasteners is not particularly feasible as such fasteners may disrupt the function of the heating element or cause short circuits therein as well as either disrupting or not providing a water impervious structure. The fastening of the various lamina, however, must be sufficient to provide a securely interconnected structure that maintains its configuration against forces that are normally applied to mats used for melting ice and snow and preferably also provides durability, electrical insulation and water imperviousness.

The releasably fastenable vampire clamp that interconnects a mat with electrical powering system 11 communicates from fasteners 29 carried by contact strips 28 of the heating element 25 by paired wires 30. The clamp provides rigid "U" shaped body 31 defining medial channel 32 extending therethrough to carry an insulated conductor to be interconnected. The medial portion of channel 32 carries two electrically conductive contacts 33, each having upwardly projecting connecting spikes 34 electrically interconnected with one of the wires 30. The spikes 34 are positioned in laterally spaced fashion so that each will pierce the insulation and contact different laterally spaced conductors of a normal insulated two-wire, side-by-side electrical wire. Top element 35 fits into the upper portion of channel 32 with its lateral edges slidably engaged in opposed cooperating channels 36 defined in the inner surfaces of the upper body portion to releasably fasten the top within the body. As the top is moved into fastening position in the body structure, the electrical conductor carried in channel 32 is maintained in a downward position so that spikes 34 pierce through the insulation of that conductor and make electrical contact with the adjacent wire to form an electrical communication with both wires of an electrical conductor. Once established, the vampire clamp will remain in this connecting mode as long as the top structure is positionally maintained in channels 36. If it be desired to move the conductor, top 35 is removed from body 31 by sliding it out of channels 36 so that the electrical conductor may be moved upwardly to release it from interconnection with the clamp spikes. As the insulation on most electrical conductors has some resilient deformability and retentive memory, that insulation will substantially reform over the area that was pierced by spikes 4 to maintain an insulative covering. The conductor may then be moved to a new position on the electrical conductor and reconnected as desired. This type of vampire connector is known in the present day electrical arts and is therefore not described in detail as it constitutes only a necessary combinational element of my invention and is not a novel element per se.

Figure 6:
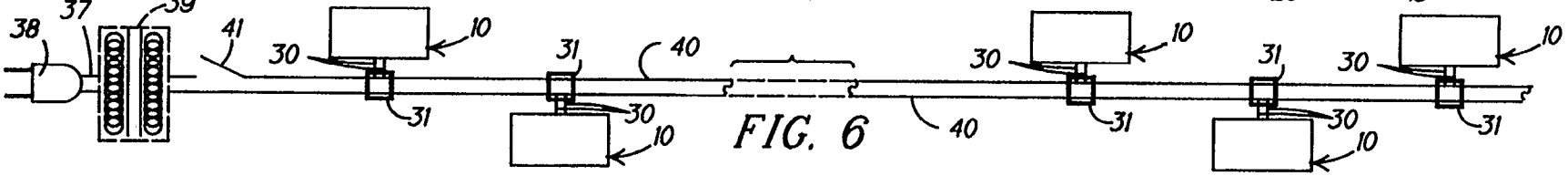
FIG. 6 is a diagram in normal symbology of the electrical circuitry powering my mat structure.

Electrical powering system 11, as seen symbolically in FIG. 6, provides two-wire conductor 37 having plug 38 at its end for releasable interconnection with an ordinary household type single phase, one hundred twenty volt power source. Conductor 37 communicates to stepped down transformer 39 which in turn communicates by conductor 40 through switch 41 and a spaced distance therebeyond to interconnect a plurality of heated mats. The conductor 40 provides two side-by-side wires in spaced relationship covered by a resiliently deformable insulative covering extending between and about both conductors. The length of conductor 40 beyond switch 41 is not critical, but normally should be at least ten to twenty feet to allow interconnection of a plurality of spaced mats therealong to create normally desired arrays of such mats. It is to be noted that the various heating mats are interconnected in electrical parallel with conductor 40 so that if desired, the conductor may be cut off to shorten it for particular configurations.

Transformer 39 is an ordinary iron core transformer that lowers input voltage of a one hundred twenty volt, single phase household current to not more than fifty and preferably twenty-four volts. Normally the transformer output current will also be of a single phase alternating type, but this output may be rectified if desired to provide a direct current as the resistive heating element 25 will operate equally well on either alternating or direct current. The lower voltage used to power my heating pads is desired to prevent injury or damage to humans or animals using the mat, should short circuits occur accidentally by reason of the wet environments in which the device is used or otherwise. The amount and electrical nature of foil heating element 25 is determined by ordinary engineering methods to produce approximately 0.15 to 1 watt per square inch of mat surface which will provide adequate heat to melt ice and snow but yet not waste energy in so doing. The transformer 39 should have sufficient capacity to service the number of heating pads that are interconnected to conductor 40 without substantial voltage drop. As one example, a normal array of ten 8×18 inch heated mats with an output of approximately 192 watts each and with appropriate safety factors, requires a transformer of approximately 1400 watt capacity. As another example, the low voltage heated mat structure can be configured to include a 32 volt source and an array of fifteen 8×24 inch heated mats (each generating 0.25–0.75 watt per square inch), whereby individual heated mats output approximately 48–70 watts. A power source having an approximate 1000 watt capacity is used t drive this array.

The use of my system can be understood from the foregoing description of its structure.

An electrical powering system is formed according to the foregoing specification, with conductor 40 extending spacedly from transformer 39 and in or adjacent to the area that is to be serviced by heated mats. A plurality of heated mats are then selected and positioned adjacent the conductor 40 in positions where they are to melt ice and snow, such as on a series of steps as illustrated in FIG. 1. The heated mats may be positionally maintained by means of mechanical fasteners passing through fastening holes 27 and into fastening engagement with a supporting surface or by means of the adhesive elements 15. For some use it may be desirable not to fasten the heated mats for positional maintenance on a supporting surface and if so, the mats are merely placed in surface engagement on a surface to be serviced.

After mat placement, the vampire clamps are opened by removing their top element 35 and each is appropriately positioned on conductor 40, with the conductor in channel 32 defined by the connector body immediately above pointed spikes 34. The conductor 40 is moved down upon spikes 34 to make electrical contact with each associated conductor and the top element is then replaced. There will then be a resulting electrical circuit from the conductor 40 through foil heating elements 25 of each interconnected mat. In this condition, the electrical system is interconnected with a powering source by plugging electrical conductor 37 into an appropriate receptacle provided by that source and turning switch 41 to allow current to pass into the electrical circuit. The device remains operative until some change is made to terminate the electrical supply system, by use of switch 41 or disconnection of the electrical system from its power supply.

It is to be particularly noted that a plurality of individual heated mats may be used in my system in varying arrays, and in fact only a single mat might be used if desired. There is no particular limit to either the size of individual heated mats or the number of mats that may be used in the system, though practical limitations dictate a mat size of approximately eight by twenty-four inches to allow use on normal structures on which the mats are to be used, and the normal electric capacity of economically available transformers and wiring systems generally for economic feasibility require a power limit of not more than about thirty-five hundred watts which will tend to limit the number of mats serviced by one electrical powering system to less than approximately twenty.

It is further to be noted that conductor 40 may be positioned at a spaced distance from each heated mat by reason of the extension of the vampire connectors from the mat structure. This distance may be varied to suit particular needs, but generally need not be more than a few inches. The separation of the mats spacedly from the power conductor has advantage in allowing the conductor to be maintained spacedly from the mats, such as in the case of stair steps where the conductor may be positioned on the vertical sides of the step structure which tends to allow water drainage to maintain the conductor and vampire clamps in a dryer condition. Similarly, this arrangement tends to maintain the powering conductor 40 in positions that will not meet with such great physical abuse as the mat structures themselves.

It is further to be noted from the structure described that the heated mats use a relatively small amount of power and because of this may be continuously operated during periods of need to avoid the complexities and problems associated with timers and thermostatic control devices. This low power use is occasioned primarily by the type of resistive foil element that allows operation at low voltages and is enhanced by the structure of the mat itself which tends to cause substantially more heat to be directed upwardly from the upper surface of the mat then downwardly through its back. Heat passing through the back of the mat tends only to heat supportative surfaces which dissipate the heat in relatively non-beneficial fashion.

The foregoing description of my invention is necessarily of a detailed nature so that a specific embodiment of it might be set forth as required, but it is to be understood that various modifications of detail, rearranged and multiplication of parts might be resorted to without departing from its spirit, essence or scope.

Having thusly described my invention, what I desire to protect by Letters Patent, and

What I claim is:

1. A selectively arrayable, electrically heated mat structure for melting environmental ice and snow, comprising in combination:

a plurality of relatively thin, flat mats with a laminate structure, each mat having, a substantially rigid back with lower thermal conductivity than an upper surface layer and means for positional maintenance on an underlying supporting surface, a heating lamina, of the same configurational shape and size as the back and supported on the entire upper surface of the back, said heating lamina having an electrically resistive metallic heating element, formed by an elongate strip of foil covering at least one-fourth of the surface area of the heating lamina in substantially areally uniform array and of electrical resistivity to generate approximately 0.15 to 1 watt per square inch of mat uniformally over the entire mat, said heating element having contact strips at each end electrically communicating with a connector spacedly distant from the mat to releasably and non-destructively interconnect the heating element to an electrical conductor, and a semi-rigid upper surface layer, of the same configuration and size as the back, supported on the entire upper surface of the heating lamina, said upper surface layer having an exposed upper surface of high frictional nature to aid in preventing slippage of a user of the mat; and an electrical powering system having an output voltage not greater than 50 volts, and through an elongate two-wire electrical conductor to which a plurality of mats are releasably interconnected in electrical parallel in predetermined spaced array by releasably positionable vampire type connectors.

2. The apparatus of claim 1 wherein:

the means for positionally maintaining a mat on an underlying supporting surface comprise a plurality of holes defined through the mat to receive mechanical fasteners extending into releasable fastenable communication with an underlying supporting surface, the back is formed of polymeric material having elongate glass fibers imbedded therein for insulation and strength, the heating lamina have layers of sheet plastic on each side thereof between that heating lamina and the upper surface layer and between that lamina and the back and a polymeric side strip covering the peripheral edges of the mat.

3. The apparatus of claim 1 wherein the electrical system has an output voltage of not more than 32 volts and is powered by single phase household type electrical current of approximately one hundred twenty volts.

* * * * *